US005183080A

United States Patent [19]

Bassi et al.

[11] Patent Number: 5,183,080

[45] Date of Patent: Feb. 2, 1993

[54] SHED FORMING DEVICE FOR GRIFFE FRAMES

[75] Inventors: Dario Bassi, Chaponnay; Joseph Palau, Duingt, both of France

[73] Assignee: Etablissements Staubli-Verdol, Chassieu, France

[21] Appl. No.: 797,078

[22] Filed: Nov. 25, 1991

[30] Foreign Application Priority Data

Nov. 27, 1990 [FR] France ..... 90 15140

[51] Int. Cl.[5] ..... D03C 3/36

[52] U.S. Cl. ..... 139/55.1; 139/62; 139/1 E

[58] Field of Search ..... 139/79, 80, 81, 66 R, 139/68, 71, 59, 65, 55.1, 58, 62, 1 E, 329

[56] References Cited

U.S. PATENT DOCUMENTS 2,596,177 5/1952 Schiavon ..... 139/79
2,727,538 12/1955 Widmer ..... 139/55.1 X
4,337,801 7/1982 Suzuki et al. ..... 139/79 X
4,534,385 8/1985 Froment et al. ..... 139/79

*Primary Examiner*—Andrew M. Falik
*Attorney, Agent, or Firm*—Dowell & Dowell

[57] ABSTRACT

An assembly for controlling the reciprocating movement of the upper and lower frames of a shed-forming device of a weaving loom wherein on the chassis on either side of the shed-forming device two cams are provided which are each in engagement with the end of an offset lever fitted on a shaft to which is connected a balance beam. The ends of the balance beam are connected to the first ends of two connecting rods which have their other ends articulated to first and second rocking levers. The first rocking lever is split having oppositely oriented spaced arms which are separated by the second rocking lever. The first rocking lever is fitted on a pin pivoting in a bearing on the chassis. The second rocking lever is mounted to rotate about the pin of the first rocking lever and the first and second rocking levers are connected to the upper and lower frames by short and long articulated levers.

4 Claims, 3 Drawing Sheets

SHED FORMING DEVICE FOR GRIFFE FRAMES

BACKGROUND OF THE INVENTION

1. Field of the Invention

The present invention relates to an assembly for controlling the reciprocating movement of the frames of a shed-forming device in a weaving loom.

2. History of the Related Art

The shed-forming devices of a weaving loom are known to comprise two frames which move in opposition in a reciprocating movement so as to control raising and lowering of the warp yarns to allow passage therebetween of a weft yarn or pick. The movement of these frames is effected due to a control assembly including cams, connecting rods and levers from a principal shaft rotating in synchronism with that of the shaft of the weaving loom.

Modern looms being more and more rapid, it is necessary to impart to the frames high speeds of reciprocation which are not always compatible with the complexity of the heretofore known control assemblies.

The object of the improvements forming the subject matter of the present invention is to provide an assembly for controlling the movement of the frames, of which the number of elements is as small as possible so as to reduce the inertia and to reduce the costs, the limitation of the number of pieces making it easier to master the mechanical clearances, therebetween.

SUMMARY OF THE INVENTION

The control assembly according to the invention comprises, on either side of the shed-forming device, two cams which are each in engagement with the end of a bent lever fitted on a shaft. The shaft is connected to a balance beam at the free ends of which are articulated the first ends of two connecting rods. The other ends of the connecting rods are respectively articulated on two rocking levers. The first rocking lever includes two arms spaced apart from each other, oriented in opposite directions, and fitted on a pin pivoting in a bearing of the chassis. The second lever includes an arm and is pivotally mounted between the two arms of the first rocking lever and mounted to rotate about the pin of the first rocking lever. The rocking levers are connected to griffe frames by articulated levers.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
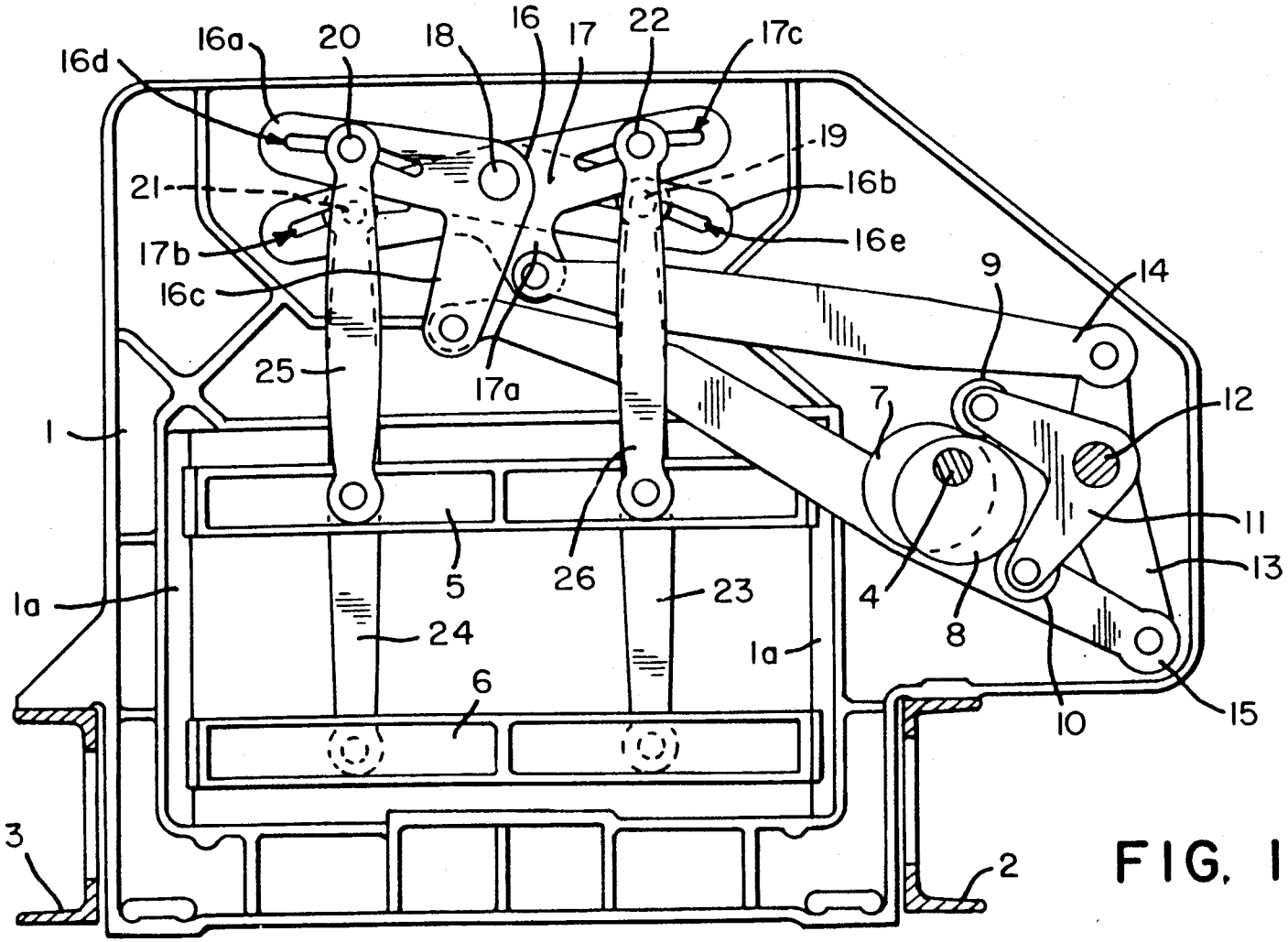
FIG. 1 is a view in elevation of a weave mechanism comprising a control assembly according to the invention.

Referring now to the drawings, FIG. 1 shows a weave mechanism which essentially comprises a chassis 1 resting on two beams 2 and 3 located above a weaving loom (not shown). In conventional manner, chassis 1 is provided with a control shaft 4 rotating in synchronism with the shaft of the weaving loom by means not shown. Chassis 1 includes slideways 1*a* along which griffe frames 5, 6 move in reciprocating and opposite manner. The frames are intended, as is well known in the art, to raise and to lower the harness cords associated with the heddles cooperating with the warp yarns disposed on the weaving loom.

On either side of chassis 1 there are angularly fitted on the projecting parts of the shaft 4 two cams 7, 8 each in engagement with the end roller 9, 10 of the arms of an offset lever 11 mounted angularly fixed with respect to a shaft 12 pivoting in chassis 1. On shaft 12 is fitted a balance beam 13 with unequal arms of which the ends are articulated on one of the ends of connecting rods 14, 15 respectively. The other ends of the rods 14, 15 are respectively articulated on two rocking levers 17, 16.

Figure 2:
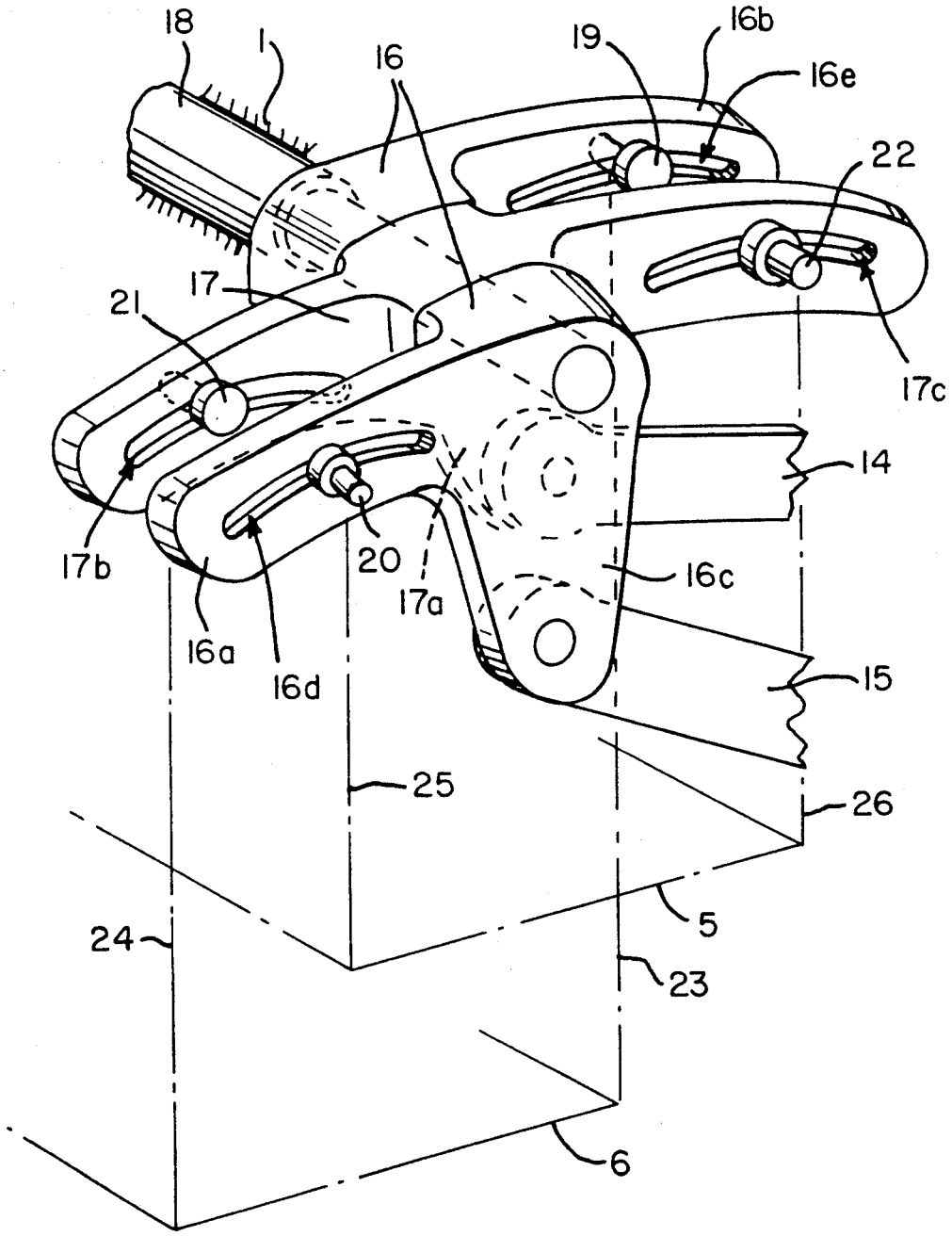
FIG. 2 is an enlarged detailed view in perspective of the two rocking levers for controlling the frames of the mechanism of FIG. 1.

As illustrated in FIG. 2, rocking lever 16 is composed of two oppositely directed arms 16*a*, 16*b* separated laterally and mounted to rotate on a fixed pin 18. The connecting rod 15 works the lateral lug 16*c* of lever 16*a*. It will be observed that the two arms 16*a*, 16*b* each includes an oblong slot 16*d*, 16*e*.

T-shaped rocking lever 17 is mounted to rotate about pin 18 and pivots because of the action of the connecting rod 14 working a lateral lug 17*a* thereof. The rocking lever 17 which is substantially in the form of a T having oppositely directed arms which include longitudinal slots 17*b*, 17*c*.

Each of the slots 16*e*, 16*d*, 17*b*, 17*c*, respectively, is associated with a pin 19, 20, 21, 22. Pins 19 and 21 are associated with one of the ends of a long vertical lever 23, 24 of which the other end is associated with the lower frame 6, while pins 20 and 22 are articulated on one of the ends of a short vertical lever 25, 26, of which the other ends are articulated on the upper frame 5.

Figure 3:
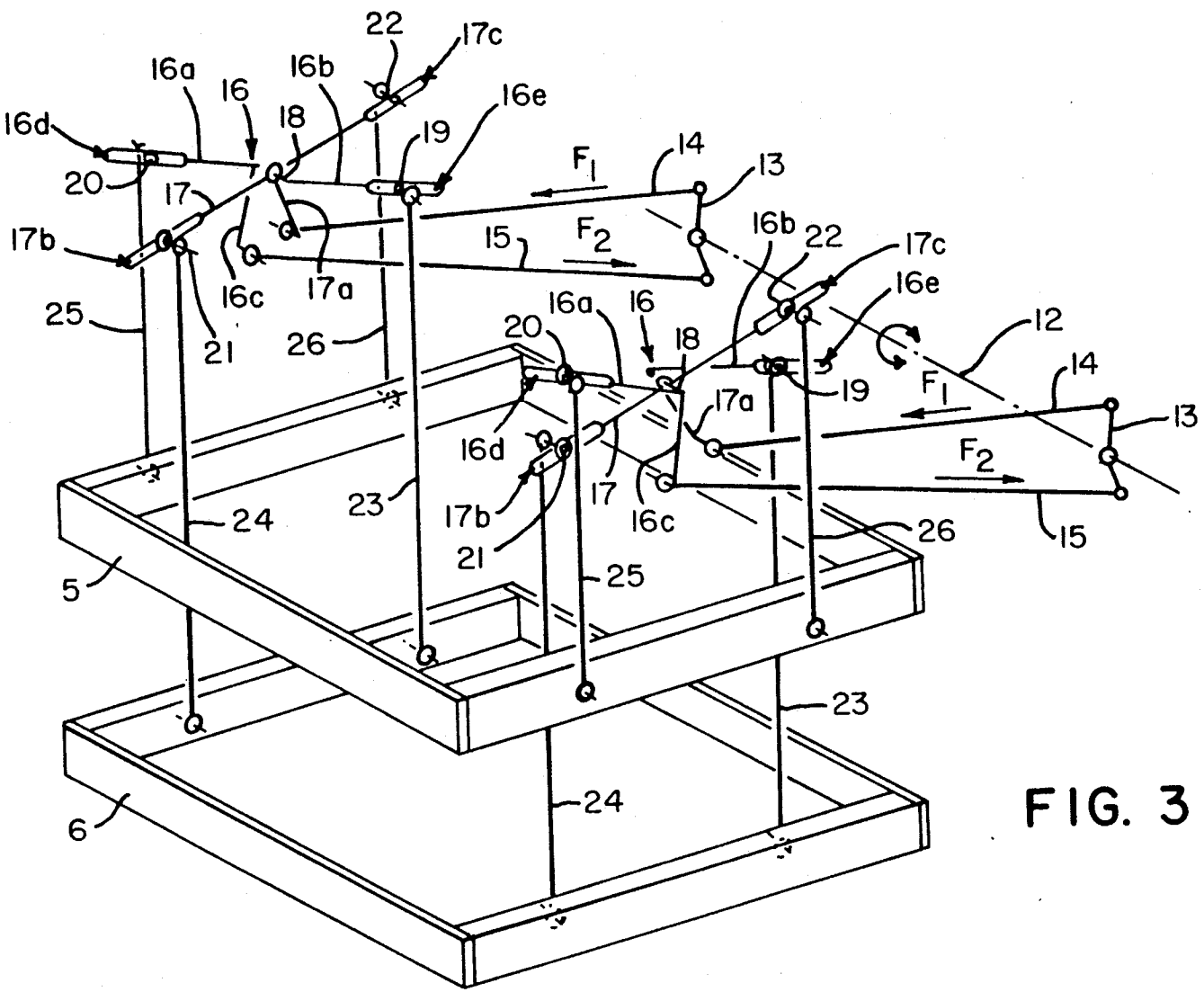
FIG. 3 is a schematic view in perspective illustrating the structure of the control assembly according to the invention.

FIG. 3 very schematically illustrates the control assembly according to the invention which shows that, on either side of the chassis including the mechanism as shown in FIG. 1. The upper frame 5 is thus attached to two vertical levers 25 and to two vertical levers 26 which are further articulated, as indicated above, on rocking levers 16 and 17. Similarly, the lower frame 6 is fastened to two levers 23 and to two levers 24 dependent on rocking levers 16, 17.

When shaft 12 rotates in one direction and in the other, the balance beams 13 cause the connecting rods to move in the direction of arrows F1, F2, i.e. in opposite directions so that the two levers 16 and 17 tip in opposite directions on each side of the mechanism. In this way, frames 5 and 6 are alternately raised and lowered in opposite directions.

By displacing adjustable pins 19-22 in their respective slots, either a parallel displacement of the frames may be obtained, or a displacement with a certain angular opening in relationship to the chassis so as to constitute an oblique shed.

A control of frames 5 and 6 which is as direct as possible is thus produced, thus resulting in a high precision and consequently a speed greater than that of the mechanisms whose frames are driven by more complex assemblies.

What is claimed is:

1. In a shed-forming device for a weaving loom which includes a chassis having opposite sides and upper and lower griffe frames having opposite sides, and a control assembly for controlling the reciprocal movement of the upper and lower griffe frames relative to the chassis, the control assembly comprising, a first rotatable shaft, a pair of cams mounted to said first shaft, a second shaft spaced from said first shaft, an offset lever mounted on said second shaft, said offset lever having first and second arms operably engaged with said cams, a balance beam mounted to said second shaft and having opposite ends, first and second connecting rods having opposite ends, one of said ends of said first and second connecting rods being connected to opposite ends of said balance beam, a first rocking lever means having a pair of spaced and generally oppositely oriented arm portions, a second rocking lever means disposed between said arm portions of said first rocking lever means and having generally oppositely oriented arm portions, said first and second rocking levers being pivotally mounted about a first pin means, the other of said ends of said first connecting rod being connected to said first rocking lever means and the other of said ends of said second connecting rod being connected to said second rocking lever means, and articulating lever means for connecting said first and second rocking levers to one side of the upper and lower griffe frames.

2. The control assembly for a shed-forming device of claim 1 in which said articulating lever means includes a pair of first short levers connected to said one side of the upper griffe frame and a second pair of long levers connected to said one side of the lower griffe frame, one of each of said first and second levers being secured to said opposite arm portions of said first and second rocking lever means.

3. The control assembly for a shed-forming device of claim 2 including an elongated slot in each of said arm portions of said first and second rocking lever means, and adjustable pin means for securing said first and second levers along said slots to thereby adjust the angle of the upper and lower griffe frames relative to the chassis.

4. The control assembly for a shed-forming device of claim 3 in which said second rocking lever means is generally T-shaped.

* * * * *